US008494386B2

(12) United States Patent
Hirata

(10) Patent No.: US 8,494,386 B2
(45) Date of Patent: Jul. 23, 2013

(54) IMAGE FORMING APPARATUS FEATURING CONTROL OF TONER SUPPLY BETWEEN IMAGE BEARING MEMBER AND CLEANING BLADE

(75) Inventor: Yuichiro Hirata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 289 days.

(21) Appl. No.: 12/973,181

(22) Filed: Dec. 20, 2010

(65) Prior Publication Data

US 2011/0150547 A1 Jun. 23, 2011

(30) Foreign Application Priority Data

Dec. 21, 2009 (JP) ..... 2009-289391
Dec. 10, 2010 (JP) ..... 2010-275757

(51) Int. Cl.
*G03G 15/08* (2006.01)

(52) U.S. Cl.
USPC ..... 399/53

(58) Field of Classification Search
USPC ..... 399/38, 53–56, 252, 254, 258
See application file for complete search history.

(56) References Cited

U.S. PATENT DOCUMENTS 7,251,440 B2 * 7/2007 Shigeta et al. ..... 399/254
7,272,331 B2 * 9/2007 Kobayashi et al. ..... 399/44
7,450,868 B2 * 11/2008 Kunikawa ..... 399/27

FOREIGN PATENT DOCUMENTS

JP 10-161426 A 6/1998

OTHER PUBLICATIONS

Computer translation into English of Japanese Patent Application No. 10-161426, as published on Jun. 19, 1998.

* cited by examiner

*Primary Examiner* — Hoan Tran
(74) *Attorney, Agent, or Firm* — Fitzpatrick, Cella, Harper & Scinto

(57) ABSTRACT

An image forming apparatus includes a first drum for bearing an electrostatic latent image and a cleaning blade of a first cleaning device when formation of the toner image to be transferred onto a sheet is not carried out. The control device selects between a toner supply process using the toner accommodated in a first developing device and a toner supply process using the toner accommodated in a second developing device, in accordance with an amount of the toner accommodated in the first developing device or the second developing device.

17 Claims, 5 Drawing Sheets

IMAGE FORMING APPARATUS FEATURING CONTROL OF TONER SUPPLY BETWEEN IMAGE BEARING MEMBER AND CLEANING BLADE

FIELD OF THE INVENTION AND RELATED ART

The present invention relates to an image forming apparatus which employs an electrophotographic image formation method.

There has been known an image forming apparatus having: multiple image bearing members, the number of which corresponds to the number of toners different in color and/or other properties; multiple development units which correspond one for one to the multiple image bearing members; and a circularly movable belt which is placed in contact with the peripheral surface of each of the multiple image bearing members. In the case of an image forming apparatus structured as described above, an image can be formed on a sheet of recording medium by forming a toner image on the peripheral surface of each of the multiple image bearing members by supplying the peripheral surface of the image bearing member with the toner from the corresponding development unit, and transferring (first transfer) the image on the peripheral surface of the image bearing member onto the sheet of recording medium on the circularly movable belt. Incidentally, there has been also known an image forming apparatus structured as described above, except that the toner image on the peripheral surface of the image bearing member is transferred (first transfer) onto the circularly movable belt, and then, is transferred (second transfer) from the belt onto the sheet of recording medium.

Further, it has been widely known that some of the image forming apparatuses of the above-described type are provided with multiple cleaning apparatuses, one for each of the multiple image bearing members, for removing the residual toner, that is, the toner remaining on the peripheral surface of each image bearing member after the toner image on the peripheral surface of the image bearing member is transferred onto the sheet of recording medium or the circularly movable belt. A cleaning apparatus used as described above has been known to be provided with a cleaning blade, that is, a blade is placed in contact with the peripheral surface of an image bearing member to scrape away the residual toner.

However, a cleaning apparatus which employs a cleaning blade suffers from the following phenomenon. That is, when the transfer residual toner is removed by the cleaning blade, if the friction between the cleaning blade and an image bearing member is excessive, the cleaning blade sometimes chatters (vibrates or repeatedly sticks and slips), and/or is bent in the opposite direction from the direction in which the peripheral surface of the image bearing member is moving. If this phenomenon occurs, not only is it impossible for the peripheral surface of the image bearing member to be satisfactorily cleaned, but also, the peripheral surface of the image bearing member is scarred, which reduces the image forming apparatus in image quality. The chattering (vibration) of the cleaning blade sometimes generates abnormal noises. As one of the solutions to these problems, there has been disclosed a technology (Japanese Laid-open Patent Application H10-161426) for preventing the above-described phenomenon, that is, the occurrence of abnormal noises and the reduction in the performance of the cleaning apparatus. According to this technology, in order to reduce the friction between the cleaning blade and image bearing member, the peripheral surface of an image bearing member is supplementally provided with the toner for lubrication from a development unit while no image is being formed by an image forming apparatus during an image forming operation.

However, the conventional image forming apparatus described above suffers from the following problem.

That is, if a development unit from which toner for lubrication is supplied to the peripheral surface of a specific image bearing member is no more in the amount of toner therein than a certain level, it is impossible for the peripheral surface of the image bearing member to be supplied with a sufficient amount of toner for lubrication, and therefore, it is impossible for the friction between the peripheral surface of the image bearing member and the corresponding cleaning blade to be satisfactorily reduced. Thus, the image quality reduction and the generation of abnormal noises, such as those described above, occur. Further, supplying the peripheral surface of a given image bearing member with the toner from a specific development unit increases the specific development unit in toner consumption, which may result in the problem that the specific development unit runs out of toner in the midst of an image forming operation.

SUMMARY OF THE INVENTION

Thus, the primary object of the present invention is to provide an electrophotographic image forming apparatus which has multiple image bearing members, corresponding number of development units, and corresponding number of cleaning apparatuses, and is capable of properly supplying the peripheral surface of each image bearing member with toner for lubrication as necessary while no image is formed during an image forming operation.

According to an aspect of the present invention, there is provided an image forming apparatus comprising a first image bearing member for bearing an electrostatic latent image; a first developing device for developing the electrostatic latent image with toner into a toner image on said first image bearing member; a first cleaning device having a cleaning blade for removing residual toner from said first image bearing member; a second image bearing member for bearing an electrostatic latent image; a second developing device for developing the electrostatic latent image with toner into a toner image on the second image bearing member; a second cleaning device having a cleaning blade for removing residual toner from said second image bearing member; a rotatable member contactable to said first image bearing member and said second image bearing member; wherein said rotatable member is an intermediary transfer member for receiving the toner images formed on said image bearing members and for Transferring the toner images received by said rotatable member onto a sheet material, or a feeding member for feeding a sheet material for receiving the toner images formed on said image bearing members; and a control device for controlling a toner supply process for supplying toner into between said first image bearing member and said cleaning blade of said first cleaning device when formation of the toner image to be transferred onto the sheet material is not carried out, wherein said control device selects between the toner supply process using the toner accommodated in said first developing device and the toner supply process using the toner accommodated in said second developing device, in accordance with an amount of the toner accommodated in said first developing device or said second developing device.

According to another aspect of the present invention, there is provided an image forming apparatus comprising: a first image bearing member for bearing an electrostatic latent image; a first developing device for developing the electrostatic latent image with toner into a toner image on said first image bearing member; a first cleaning device having a cleaning blade for removing residual toner from said first image bearing member; a second image bearing member for bearing the electrostatic latent image; a second developing device for developing the electrostatic latent image with toner into a toner image on the second image bearing member; a second cleaning device having a cleaning blade for removing residual toner from said second image bearing member; a rotatable member contactable to said first image bearing member and said second image bearing member; wherein said rotatable member is an intermediary transfer member for receiving the toner images formed on said image bearing members and for Transferring the toner images received by said rotatable member onto a sheet material, or a feeding member for feeding a sheet material for receiving the toner images formed on said image bearing members; and a control device for controlling a toner supply process for supplying toner into between said first image bearing member and said cleaning blade of said first cleaning device when formation of the toner image to be transferred onto the sheet material is not carried out, wherein said first developing device is detachably mountable to the main assembly of the apparatus, and when said first developing device is not mounted to the main assembly, said control device executes the toner supply process using the toner Accommodated in said first developing device, and when said first developing device is not mounted to the main assembly, the toner supply process is executed using the toner accommodated in said second developing device.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, referring to the appended drawings, the present invention is described in detail with reference to preferred embodiments of the present invention. The measurements, sizes, and shapes of the structural components of the image forming apparatuses, and their positional relationship, in the following embodiments of the present invention are not intended to limit the present invention in scope, unless specifically noted.

Embodiment 1

Figure 1:
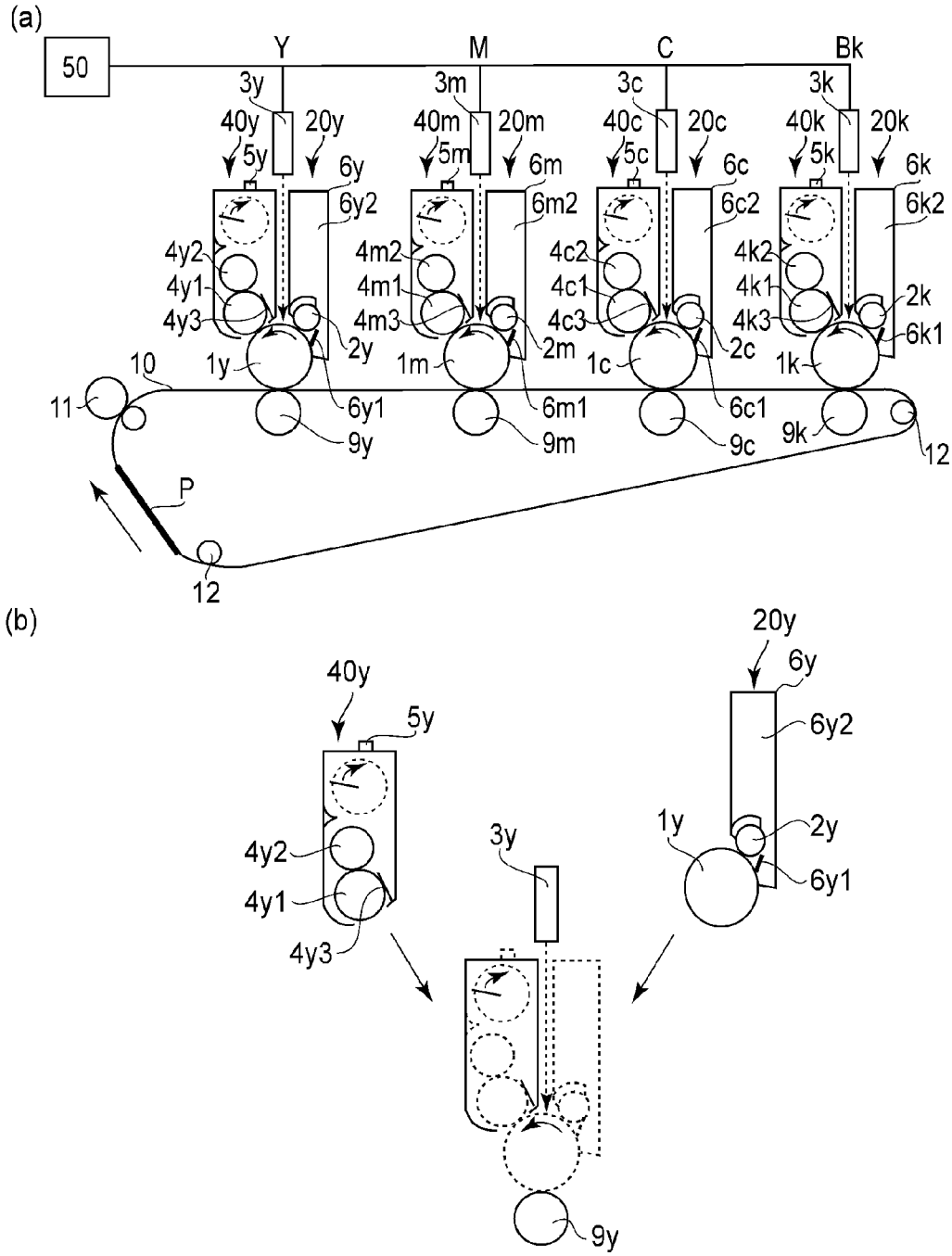
FIG. 1 is a schematic sectional view of an image forming apparatus in the first preferred embodiment of the present invention, and shows the general structure of the apparatus.
Figure 2:
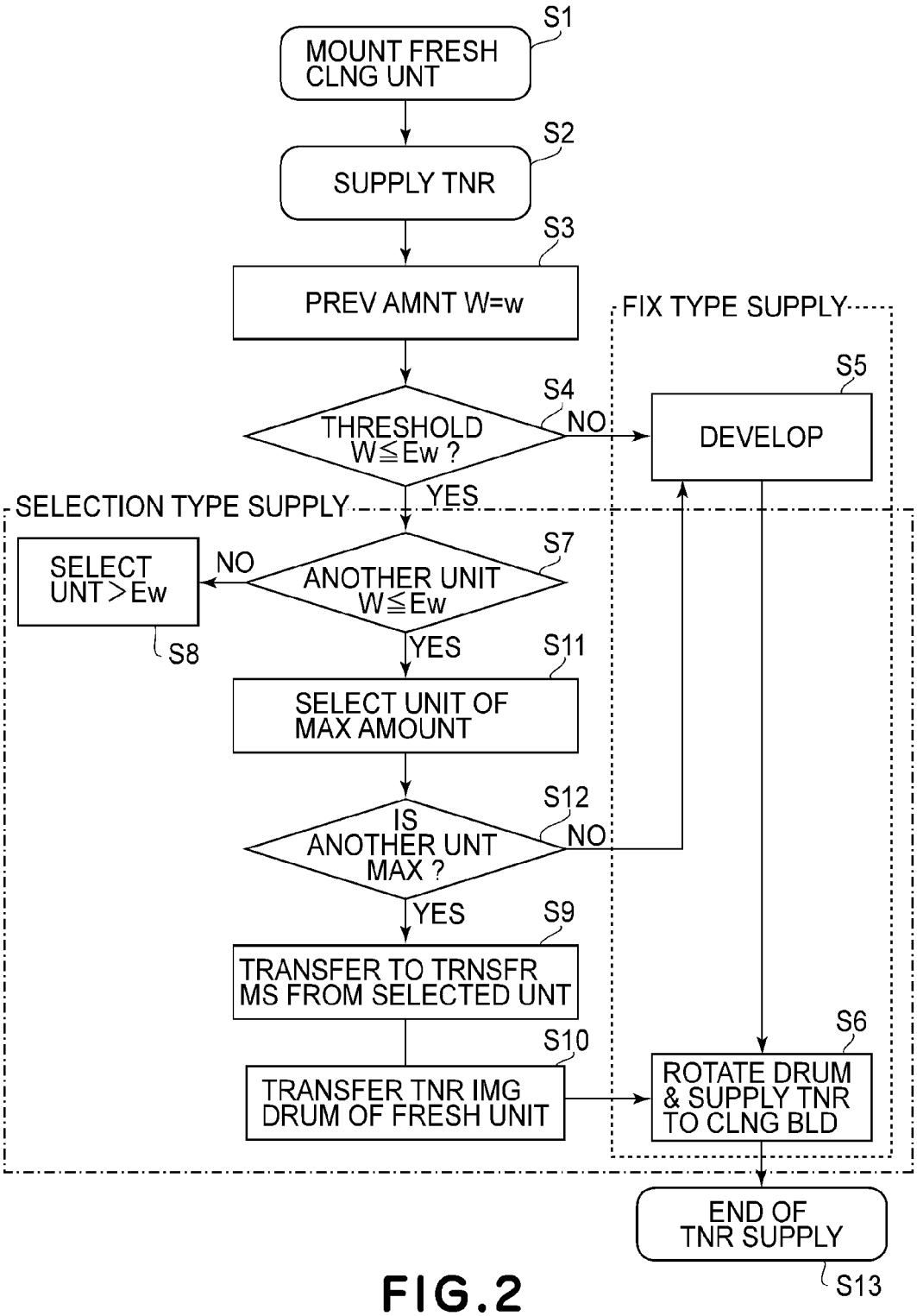
FIG. 2 is a flowchart of the process for supplying the peripheral surface of a specific image bearing member with toner, in the first preferred embodiment of the present invention.

First, referring to FIGS. 1 and 2, the first preferred embodiment of the present invention is described.

(1-1: General Structure of Image Forming Apparatus)

FIG. 1(*a*) shows the general structure of the image forming apparatus in this embodiment. The image forming apparatus in this embodiment is a full-color laser beam printer, which uses an electrophotographic image forming method.

The image forming apparatus has four image forming stations Y, M, C, and Bk, which correspond to yellow (Y), magenta (M), cyan (C), and black (Bk) colors of the toners they use, respectively. The four image forming stations are aligned in parallel in the direction (left to right in FIG. 1) in which a recording medium conveyance belt 10 (circularly movable recording medium conveying member, which conveys sheet P of recording medium to a transfer position) is circularly moved. The recording medium conveyance belt 10 can be placed in contact with, or separated from, the photosensitive drums 1*y*-1*k*, which will be described later. A desired full-color image can be formed on the sheet P of recording medium by sequentially transferring the four monochromatic toner images, different in color, onto the sheet P of recording medium on the recording medium conveyance belt 10, from the four image forming stations, one for one. An image forming method of this type is referred to as an image forming method of the "inline" type.

The four image forming stations have development units 40*y*-40*k* and cleaning units 20*y*-20*k*, respectively, which are removably mountable in the main assembly of the image forming apparatus (FIG. 1(*b*)).

The development units 40*y*-40*k* have: development rollers 4*y*1-4*k*1 for supplying the peripheral surface of photosensitive drums 1*y*-1*k* with toner (developer); and toner supply rollers 4*y*2-4*k*2 for supplying the development rollers 4*y*1-4*yk*1 with toner, respectively. Further, they have blades 4*y*3-4*k*3 for regulating in thickness the toner layer on the peripheral surface of the development rollers 4*h*1-4*k*1, respectively. These components are held together in the development unit shell. Further, the development units 40*y*-40*k* have also memories 5*y*-5*k*, which are on the frame of the development unit shell. The memories 5*y*-5*k* store the information (toner amount W in development units 40*y*-40*k*, number of revolution of development rollers 4*y*1-4*k*1, etc.) regarding the development units 40*y*-40*k*. The information in these memories 5*y*-5*k* can be transmitted to (written into, and/or read by) the control portion 50 of the main assembly of the image forming apparatus, through the communication portion of the main assembly of the image forming apparatus. Although the memories 5*y*-5*k* in this embodiment are NV-RAMs (nonvolatile RAMs) which are 2 k bytes in capacity, they do not need to be NV-RAMs. For example, they may be magnetic memories, optical memories, or the like.

The cleaning units 20*y*-20*k* have: rotatable photosensitive drums 1*y*-1*k* (image bearing members); charge rollers 2*y*-2*k* which uniformly charge the peripheral surface of the photosensitive drums 1*y*-1*k* by being placed in contact with the peripheral surface of the photosensitive drums 1*y*-1*k*; and cleaning apparatuses 6*y*-6*k*. The cleaning apparatuses 6*y*-6*k* have cleaning blades 6*y*1-6*k*1 which scrape away toner from the peripheral surface of the photosensitive drums 1*y*-1*k* by being placed in contact with the peripheral surface while the photosensitive drums 1*y*-1*k* are rotated; and waste toner containers 6y2-6k2. The cleaning blades 6y1-6k1 are desired to be formed of an elastic material such as urethane rubber. Incidentally, the photosensitive drums 1y-1k are 30 mm in diameter, and are made up of an OPC (organic photo-conductor) which is negatively chargeable. They are rotated at a peripheral velocity (process speed) of 100 mm/sec by an unshown driving power source in the direction indicated by an arrow mark.

Structuring the image forming apparatus so that the development units 40y-40k and cleaning units 20y-20k are removably mounted into, or removed from, the main assembly of the image forming apparatus as described above, makes it easier to maintenance operations, such as replenishing the image forming apparatus with toner, which in turn improves the image forming apparatus in usability.

Next, the image formation process carried out by the image forming apparatus in this embodiment, with the development units 40y-40k and cleaning units 20y-20k mounted in the main assembly of the image forming apparatus, is described.

As an image formation start signal is inputted into the control portion 50 of the apparatus main assembly, the photosensitive drums 1y-1k begin to be rotated, and charge voltage (−1.2 kV of DC voltage) begins to be applied to the charge rollers 2y-2k from an unshown electric power source. Thus, the peripheral surface of each of the photosensitive drums 1y-1k is uniformly charged to roughly −600 V. Incidentally, the charge rollers 2y-2k are $1\times10^6\Omega$ in electrical resistance, and are rotated by the rotation of the corresponding photosensitive drums 1, by being pressed upon the peripheral surface of the photosensitive drums 1 with the application of the total amount of pressure of 9.8 N (Newton).

After the peripheral surface of each of the photosensitive drums 1y-1k is uniformly charged, a beam of laser light (exposure light) is projected from exposing apparatus 3y-3k while being modulated with image formation signals, whereby the peripheral surface of each of the photosensitive drums 1y-1k is scanned by (exposed to) the beam of laser light. Consequently, an electrostatic latent image is formed on the peripheral surface of each of the photosensitive drums 1y-1k. The exposing apparatuses 3y-3k in this embodiment are polygon scanners which use a laser diode. Incidentally, as a given point of the charged portion of the peripheral surface of each photosensitive drum 1 is exposed to the beam of laser light, the potential level of the given point reduces to roughly −200 V. Regarding the writing of an electrostatic latent image by the beam of laser light, in terms of the primary scan direction (which is perpendicular to recording medium sheet conveyance direction), each point of the image is written in response to a position signal (so-called BD) from a polygon scanner, whereas in terms of the secondary scan direction (which is parallel to recording medium sheet conveyance direction), each point of the latent image is written by delaying the projection of the beam of layer light by a preset length of time in response to one of the TOP signals generated by a switch (unshown) in the recording medium sheet conveyance passage. Therefore, it is ensured that the electrostatic latent images formed on the peripheral surface of the photosensitive drums 1y-1k, one for one, by the beam of laser beam, perfectly align when they are transferred onto the intermediary transferring member, or sheet of recording medium.

Thereafter, the electrostatic latent image on the peripheral surface of the each of the photosensitive drums 1y-1k is supplied with the toner by the corresponding development roller 4 among the development roller 4y1-4k1 which are in contact with the peripheral surface of the photosensitive drums 1y-1y, respectively, whereby the electrostatic latent image is developed into a visible image, that is, an image formed of toner, which is different in color from the toners with which the electrostatic latent images on the other photosensitive drums 1 are developed. During the development of the electrostatic latent image, development voltage (roughly −350 V) is applied to each of the development roller 4y1-4k1 from an unshown electrical power source, making it possible for toner to be electrostatically supplied to the electrostatic latent images. The developer used in this embodiment is nonmagnetic single-component toner which is negatively chargeable. Also during the development, the development roller 4y1-4k1 are continuously rotated at a process speed which is 170% of the peripheral velocity of the photosensitive drums 1y-1k, in such a direction that the peripheral surface of each development roller 4 and the peripheral surface of the corresponding photosensitive drum 1 move in the same direction in the area of contact between the development drum 4 and photosensitive drum 1.

The toner images on the photosensitive drums 1y-1k are sequentially transferred onto the developer image conveyance belt 10 (endless belt), in the transfer nips (roughly 1.5 mm in dimension in terms of rotational direction of development roller 4 (photosensitive drum 1)) formed by the photosensitive drums 1y-1k and transfer rollers 9y-9k, respectively. The developer image conveyance belt 10 is suspended and kept stretched by rollers 7 and 12, and is continuously and circularly driven in the direction indicated by an arrow mark, at the same speed as the process speed at which the photosensitive drums 1y-1k are driven during the development. The conveyance belt 10 is an endless resin belt formed of a piece of single-layer polyimide film, which is $1\times10^{10}\Omega$ in electrical resistance and 100 μm in thickness. The lengthwise edges of the inward surface of the conveyance belt 10, with the reference to the loop which the belt 10 forms, are provided with a pair of ribs, one for one, for preventing the belt 10 from snaking and/or deviating in position in its widthwise direction.

The transfer rollers 9y-9k are $1\times10^5\Omega$ in volume resistivity. They are kept pressed against the peripheral surface of the photosensitive drums 1y-1k, one for one, with the presence of the conveyance belt 10 between the photosensitive drums 1 and transfer rollers 9, one for one. As transfer voltage (DC voltage) which is positive in polarity is applied to the transfer rollers 9y-9k, the toner images on the photosensitive drums 1y-1k are sequentially transferred onto the sheet P of recording medium. The transfer voltages to be applied to the transfer rollers 9y-9k are +2 kV, +2.3 kV, +2.6 kV, and +2.9 kV, respectively, listing from the upstream side in terms of the direction in which the sheet P of recording medium is conveyed. With the transfer voltages being set as described above, it is ensured that the toner image is satisfactorily transferred onto the sheet P of recording medium even in the downstream image forming stations, in which a toner image or toner images having been transferred onto the sheet P of recording medium are already on the sheet P of recording medium. Therefore, it is possible to prevent the toner images from being unsatisfactorily transferred. After the transfer of the toner images on the peripheral surface of the photosensitive drums 1y-1k onto the sheet P of recording medium (which hereafter will be referred to simply as recording sheet P), the toner remaining on the peripheral surface of the photosensitive drums 1y-1k is removed by the cleaning apparatuses 6y-6k, respectively, so that the portion of the peripheral surface of each photosensitive drum 1, which was cleared of the residual toner, can be used again for the next image formation. Incidentally, the image forming apparatus may be designed so that the transfer rollers 9y-9k are changeable in position so that each of the transfer rollers 9y-9k can be moved into the position in which it keeps the conveyance belt 10 in contact with the corresponding photosensitive drum 1, and the position in which it keeps the conveyance belt 10 separated from the corresponding photosensitive drum 1. More specifically, the image forming apparatus may be designed so that when it is used for the formation of monochromatic black images (black-and-white images), the transfer rollers 9*y*, 9*m*, and 9*c* are changed in position to keep the conveyance belt 10 separated from the photosensitive drums 1*y*, 1*m*, and 1*c*, respectively.

In the image forming apparatus described above, the recording sheet P is fed into the main assembly of the image forming apparatus from a sheet feeder cassette (unshown), and then, is conveyed to a pair of registration rollers (unshown). Then, after being moved past the registration rollers, the recording sheet P is moved onto the conveyance belt 10 through a transfer station entrance guide (unshown). When the recording sheet P is moved onto the conveyance belt 10, an adhesion roller 11, which is in contact with the conveyance belt 10, is being supplied with 1 kV of voltage so that the charged recording sheet P remains electrostatically adhered to the conveyance belt 10.

After the four toner images, different in color, are sequentially transferred onto the recording sheet P in the four transfer nips, one for one, the recording sheet P is separated by the curvature of the endless conveyance belt 10, and is conveyed into a fixing apparatus (unshown). In the fixing apparatus, the four toner images are fixed to the recording sheet P by the pressure and heat applied to the recording sheet P in the fixing apparatus, ending the formation of a full-color copy based on the four primary colors. Then, the recording sheet P is discharged from the main assembly of the image forming apparatus.

(1-2: Process for Delivering Toner for Lubrication)

The image forming apparatus in this embodiment can carry out a process for delivering supplementary toner, as lubricant, to the peripheral surface of the photosensitive drums 1*y*-1*k* in order to reduce the friction between the cleaning blades 6*y*1-6*k*1 and the peripheral surface of the photosensitive drums 1*y*-1*k*, during a period in which no image is formed during an image formation. A period in which no image is formed means such a period that the photosensitive drums 1*y*-1*k* are preparatorily rotated for an image formation, a period that the photosensitive drums 1*y*-1*k* are rotated after the completion of the image formation, etc. In this embodiment, it is after any of the brand-new cleaning units 20*y*-20*k* are mounted that this process of delivering supplementary toner, as lubricant, to the peripheral surface of the photosensitive drums 1*y*-1*k* is carried out to ensure that the brand-new cleaning blades 6*y*1-6*k*1 smoothly slide on the peripheral surface of the photosensitive drums 1*y*-1*k*, respectively. Hereafter, the process, carried out in this embodiment, for delivering toner, as lubricant, to the peripheral surface of the photosensitive drums 1*y*-1*k* is more concretely described.

When supplementary toner is delivered as lubricant to the peripheral surface of the photosensitive drums 1*y*-1*k*, a solid toner image is formed on the peripheral surface of a photosensitive drum 1. In terms of the lengthwise direction (direction parallel to axial line of drum 1) of the photosensitive drum 1, the solid image is long enough to cover the entire range of a photosensitive drum 1. In terms of the rotational direction of the photosensitive drum 1, the solid image is adjusted in dimension (width). Hereafter, this toner image will be referred to as a lubrication toner image, and the supplementary toner to be delivered as lubricant will be referred to as lubrication toner. The lubrication toner image can be changed in its dimension in terms of the rotation direction of the photosensitive drum 1, by increasing or decreasing the length of time the peripheral surface of the photosensitive drum 1 is to be exposed, according to the amount by which toner is to be supplied to the peripheral surface of the photosensitive drum 1. The lubrication toner image formed as described above is conveyed to the area of contact between the peripheral surface of the cleaning blades 6*y*1-6*k*1 and the peripheral surface of the photosensitive drums 1*y*-1*k*, whereby it function as the lubricant for reducing the friction between the peripheral surface of the blades 6*y*1-6*k*1 and the peripheral surface of the photosensitive drums 1*y*-1*k*, respectively. Incidentally, a lubrication toner image can be formed by a method other than the "charging-exposing-developing" method described above. For example, it can be formed using a method which does not involve the charging process. That is, as long as the peripheral surface of the photosensitive drums 1*y*-1*y* can be supplied with supplementary lubrication toner, how the peripheral surface of the photosensitive drums 1*y*-1*k* are supplied with the lubrication toner does not need to be limited to the one in this embodiment.

(1-3: Internal Lubrication Toner Delivery Operation and External Lubrication Toner Delivery Operation)

Next, the characteristic features of the lubricant toner delivery operation in this embodiment are described. It is assumed that the peripheral surface of the photosensitive drum 1*y*, for example, needs to be supplied with the lubrication toner (image). If the amount of the toner in the development unit 4*y* is smaller than a certain value, the peripheral surface of the photosensitive drum 1*y* may not be supplied with a sufficient amount of lubrication toner, and therefore, the image forming apparatus may reduce in image quality and/or generate abnormal sounds, as described above. Further, as supplying the peripheral surface of the photosensitive drum 1*y* with the lubrication toner from the development unit 4*y* accelerates the development unit 4*y* in toner consumption, which may result in such a problem that the development roller 4*y* runs out of toner in the midst of image formation. In the following description of this embodiment, an operation for supplying the peripheral surface of a given photosensitive drum 1 with the toner from the development unit 4 which belongs to the same image formation station as the photosensitive drum which needs to be supplied with lubrication toner will be referred to as the "internal lubrication toner delivery operation".

The characteristic feature of this embodiment, however, is that the peripheral surface of a photosensitive drum 1 which needs to be is supplied with lubrication toner by a combination of the "internal lubrication toner delivery operation" and "external lubrication toner delivery operation" to prevent the occurrence of the above-described problems. The "external lubrication toner delivery operation" mentioned above is such an operation that if the amount of the toner in the development unit which belongs to the same image forming station as the photosensitive drum 1 which needs to be supplied with lubrication toner is smaller than a preset value, one of the other development units is selected as the lubrication toner source, and then, the photosensitive drum 1, the peripheral surface of which needs to be supplied with the lubrication toner, is supplied with the toner from the selected development unit. More concretely, a lubrication toner image is formed on the peripheral surface of the photosensitive drum 1 which corresponds to the selected development unit (second development unit). Then, this lubrication toner image is transferred onto the conveyance belt 10, is moved by the movement of the conveyance belt 10 to the area of contact between the concerned drum 1 and the conveyance belt 10, and is transferred onto the peripheral surface of the photosensitive drum 1 from the conveyance belt 10. Therefore, the operation for supplying the peripheral surface of a photosensitive drum 1 with lubrication toner can be carried out without solely relying on the development unit which corresponds to the photosensitive drum 1 which needs to be supplied with lubrication toner. Thus, it is possible to prevent the problems that an image forming apparatus reduces in image quality, generates abnormal sounds, and/or becomes insufficient in the amount of toner in the development unit(s) during the midst of image formation. Next, the flow of the control sequence for supplying the peripheral surface of the photosensitive drums 1 with lubrication toner is described.

Hereinafter, the cleaning apparatus which belongs to the image formation station in which lubrication toner is supplied to the area of contact between its cleaning blade and photosensitive drum in order to lubricate the peripheral surface of the photosensitive drum will be referred to as the first cleaning apparatus. Further, the photosensitive drum and development unit which belong to the image formation station to which toner is supplied for lubrication will be referred to as the first image bearing member and first development unit, respectively.

The cleaning apparatuses, photosensitive drums, and development units, which belong to the image formation stations other than the one to which toner is to be supplied for lubrication, will be referred to as the second cleaning apparatuses, second image bearing members, and second development units.

For example, the image formation station to which toner is supplied for lubrication is the image formation station for forming a monochromatic image of color y, the cleaning apparatus, photosensitive drum, and development unit which belong to this image formation station are the first cleaning apparatus, first image bearing member, and first developing apparatus.

(1-4: Flow of Process of Lubrication Toner Delivery)

Next, referring to FIG. 2, the flow of the process for delivering lubrication toner in this embodiment is described. Incidentally, the flow which will be described next is under the control portion 50 with which the main assembly of the image forming apparatus is provided.

First, as it is determined by the control portion 50 that there is a brand-new cleaning unit in the main assembly of the image forming apparatus (S1), lubrication toner begins to be delivered to the photosensitive drum 1 in the brand new cleaning unit (S2). In order to make it easier for a reader of this specification to follow the descriptions, it is assumed that the brand-new cleaning unit is the cleaning unit 20*y*, and lubrication tone is supplied to the drum 1*y* of the cleaning unit 20*y*. However, lubrication toner can also be delivered to a photosensitive drum 1 other than that of the cleaning unit 20*y*, as it will be needless to say.

As toner begins to be delivered for lubrication, the control portion 50 reads the information in the memories 5*y*-5*k* of the development units 40*y*-40*k*, and determines (detects) the amount W of the toner in each of the development units 40*y*-40*k*, based on the information (S3). The toner detecting portion which detects the amount W of toner in each of the development units 40*y*-40*k* is an optical means. The optical means projects a beam of laser light into the path through which the toner in the developer container portion of the development unit is moved by the toner stirring member in the developer container portion, and determines the amount W of the toner by measuring the amount by which the beam of laser light is allowed to penetrate the path. The image forming apparatus is structured so that the amount W of toner detected by the optical toner amount detecting portion is stored in the memories 5*y*-5*k* as it is detected. The toner amount detecting means for detecting the mount W of toner in the developer container portion does not need to be limited to the optical means. For example, a toner amount detecting means which determines the amount W of toner remaining in the developer container portion by counting the image dots formed on the peripheral surface of each of the photosensitive drums 1*y*-1*k* to form an image on the photosensitive drum 1, or a toner amount detecting means of the antenna type which determines the amount W of toner in the developer container portion by measuring the amount of electrostatic capacity of the developer container portion with the use of the metallic antenna placed in the developer container portion, may be used as the developer amount detecting portion.

As the amount W of toner in each of the development units 40*y*-40*k* is detected, the control portion 50 compares the detected amount W of toner with a preset threshold value Ew (S4). The threshold value Ew is for determining whether or not the above-described external lubrication toner delivery operation is to be carried out. The threshold value Ew may be set for each development unit 40 according to the amount of the toner filled in each development unit 40, or the toner capacity of each development unit 40.

If it is determined by the comparison that the amount W of toner in the developer unit 40*y* is greater than the threshold value Ew (No in S4), the photosensitive drum 1*y*, which is being rotated, is supplied with the toner from the development roller 40*y* to form a lubrication tone image on the photosensitive drum 1*y* (S5). That is, the internal lubrication toner delivery operation is carried out. In this case, in order to prevent the lubrication toner image formed on the peripheral surface of the photosensitive drum 1*y* from being transferred onto the conveyance belt 10, the transfer voltage is not applied to the transfer roller 9*y*. However, a voltage which is negative in polarity (same as polarity of toner charge) is applied to the transfer roller 9*y*, or a voltage smaller than the transfer voltage applied during an image forming operation may be applied to the transfer roller 9*y*.

Thus, the lubrication toner image formed on the peripheral surface of the photosensitive drum 1*y* is delivered to the area of contact between the cleaning blade 6*y*1 and the peripheral surface of the photosensitive drum 1*y* by the rotation of the photosensitive drum 1*y* (S6). Then, the rotation of the photosensitive drum 1*y* is stopped, ending the lubrication toner image delivery process (S13).

On the other hand, if it is determined by the comparison that the amount W of the toner in the development unit 40*y* is no more than the threshold value Ew (Yes in S4), the amounts of toner in the development units 40*m*, 40*c*, and 40*k* are compared to the threshold value Ew to find a development unit 40, the amount W of toner in which is greater than the threshold value Ew (S7). At this point, the "external lubrication toner delivery operation" is started. If there are two or more developer units, the amount of toner in which is greater than the threshold value Ew, one of them is selected as the second development unit. Here, it is assumed that the development unit 40*m* was selected as the second developing apparatus. Then, toner for lubrication is supplied to the peripheral surface of the photosensitive drum 1*m* from the development unit 40*m*, whereby a lubrication toner image is formed on the peripheral surface of the photosensitive drum 1*m*. Then, the lubrication toner image is transferred onto the conveyance belt 10 by the application of +2.5 kV of transfer voltage, which is opposite in polarity to the toner, to the transfer roller 9*m* (S9). Then, the lubrication toner image on the conveyance belt 10 is conveyed by the circular movement of the conveyance belt 10 to the transfer nip formed by the photosensitive drum 1*y* and transfer roller 9*y*. At the moment when the lubrication toner image arrives at the transfer nip, the cleaning apparatus (unshown) for removing the toner remaining on the conveyance belt 10 after the image transfer, and the adhesion roller 11, which are separable from the conveyance belt 10, are separated from the conveyance belt 10.

As the lubrication toner image arrives at the transfer nip, −2.5 kV of voltage, which is the same in polarity as the toner charge, begins to be applied to the transfer roller 9*y*, whereby the lubrication toner image on the conveyance belt 10 is transferred from the conveyance belt 10 onto the peripheral surface of the photosensitive drum 1*y* (S10). Thereafter, the lubrication toner image is supplied to the area of contact between the cleaning blade 6*y*1 and the peripheral surface of the photosensitive drum 1*y* by the rotation of the photosensitive drum 1*y* (S6). Then, the rotational driving of the photosensitive drum 1*y* is stopped, ending the lubrication toner image delivery process (S13).

If it is determined in S7 that there is no development unit, the amount of the toner in which is greater than the threshold value Ew, the control portion 50 compares the development units 40*y*, 40*m*, 40*c*, and 40*k* in terms of the amount W of toner therein, and selects the developer unit which is the largest in the amount W of toner, as the developer unit from which lubrication toner is delivered (S11). If the developer unit which is largest in the amount W of the toner therein belongs to the same image formation station as the photosensitive drum 1 which needs to be supplied with lubrication toner (S12), the "internal lubricant toner delivery operation" described above is carried out. That is, the photosensitive drum 1 which needs to be supplied with lubrication toner is supplied with lubrication toner from the development unit which belongs to the same image formation station as the photosensitive drum 1 (S5 and S6). Then, the rotational driving of the photosensitive drum 1 is stopped, ending the lubrication toner delivery process (S13).

If it is determined in S12 that the development unit which is largest in the amount of the toner therein is not the development unit which belongs to the image formation station to which the photosensitive drum 1 which needs to be supplied with lubrication toner belongs, the control portion 50 carries out the "external lubrication toner delivery operation". That is, the cleaning blade is supplied with lubrication toner through a transferring means (S9, S10, and S6), and then, the external lubrication toner delivery process is ended (S13).

Incidentally, in this embodiment, in order to transfer the lubrication toner image onto the peripheral surface of the photosensitive drum 1*y* in S9, the preset voltage was applied. Instead, the conveyance belt 10 and photosensitive drum 1*y* may be made different in peripheral velocity. That is, the lubrication toner can be rubbed onto the peripheral surface of the photosensitive drum 1*y* from the lubrication toner image on the conveyance belt 10 by making the photosensitive drum 1*y* slower in peripheral velocity than the conveyance belt 10.

Here, it was assumed that the development unit 40*m* was selected as the lubrication toner source from among the development units 40*m*, 40*c*, and 40*k*, which belong to the image formation stations which did not require the cleaning blade lubrication. However, the development unit 40*c* or 40*k* may be selected as the lubrication toner source as long as the amount of the toner in the development unit 40*c* and the amount of the toner in the development unit 40*k* are greater than the threshold value Ew, which is needless to say. Further, multiple development units may be selected as the lubrication toner source for the formation of a lubrication toner image, as long as the amount of toner therein are greater than the threshold value Ew. Further, if it becomes necessary to supply multiple photosensitive drums 1 with lubrication toner at the same time, the "internal lubrication toner delivery operation" and "external lubrication toner delivery operation" may be simultaneously carried out.

To sum up, in the case of this embodiment, the amount W of toner in the development unit (first development unit) in a given image formation station is too small for internal lubrication toner delivery, that is, to supply the peripheral surface of the photosensitive drum 1 which belongs to the same image formation station, the peripheral surface of the photosensitive drum 1 in this image formation station can be supplied with the lubrication toner from one or more of the other development units (second development units) which are greater in the amount W of toner therein than the first development unit. Therefore, the above-described problems which image forming apparatuses in accordance with the prior arts suffer do not occur. That is, the image forming apparatus in this embodiment does not suffer from the above-described problems that the shortage in the lubrication toner on the peripheral surface of an image bearing member reduces an image forming apparatus in image quality, increases in abnormal sounds, and/or cause the apparatus to be become insufficient in the amount of toner in the midst of image formation.

In other words, the present invention can provide an electrophotographic image forming apparatus which employs multiple image bearing members, and corresponding number of combinations of a development unit and a cleaning apparatus, and which is capable of supplying the peripheral surface of each of the multiple image bearing members with a satisfactory amount of lubrication toner while no image is formed during an image forming operation.

Embodiment 2

Figure 3:
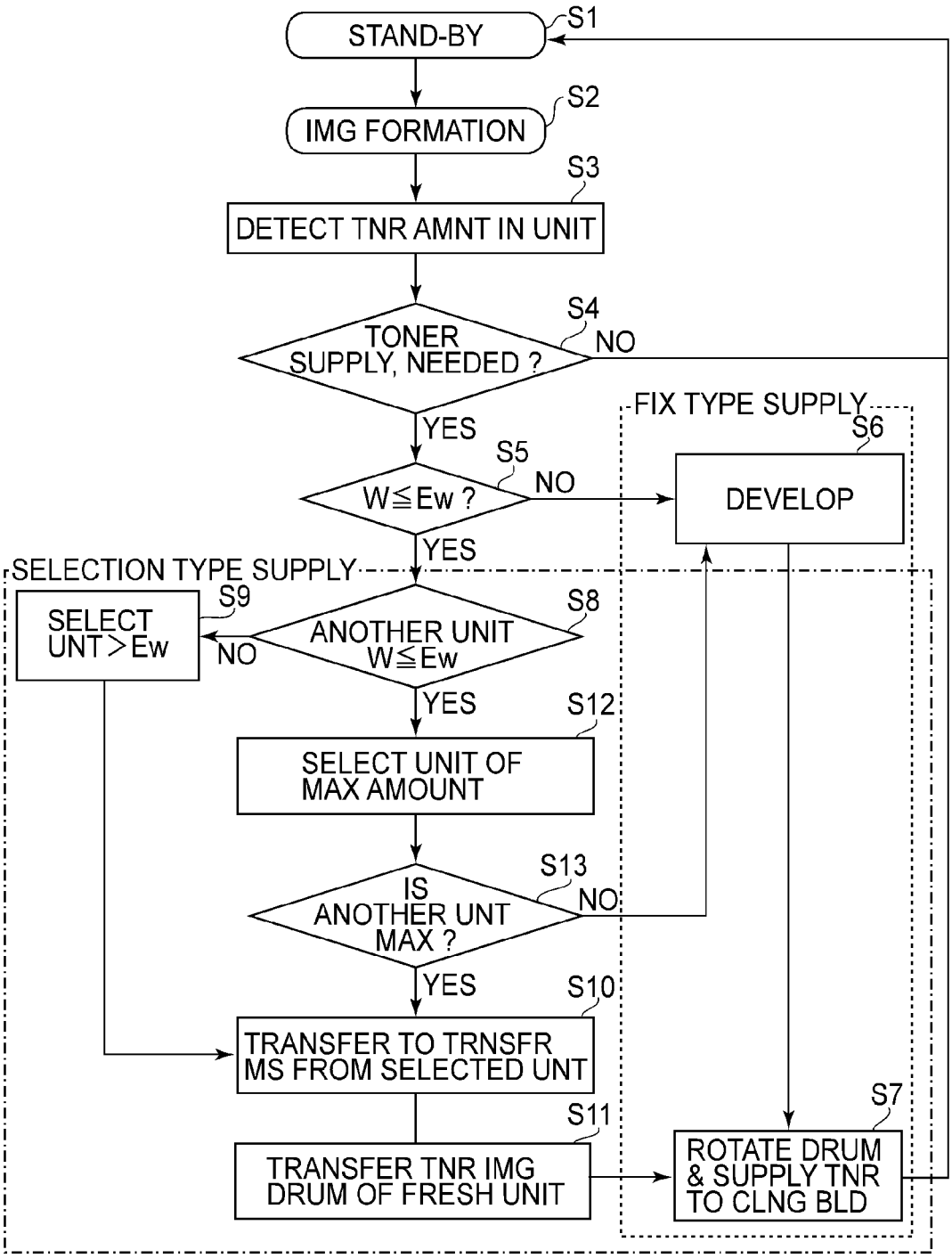
FIG. 3 is a flowchart of the process for supplying the peripheral surface of a specific image bearing member with toner, in the second preferred embodiment of the present invention.

Next, referring to FIG. 3, the second preferred embodiment of the present invention is described. In the first embodiment described above, the lubrication toner delivery process is carried out right after a brand-new cleaning unit is mounted into the main assembly of the image forming apparatus. This embodiment is different from the first embodiment in that the lubrication toner delivery process is carried out while the image forming apparatus is idled after the completion of an image forming operation, instead of right after the mounting of a brand-new development unit into the apparatus main assembly. Incidentally, this embodiment is virtually the same as the first embodiment, except for the flow of the lubrication toner delivery process. Thus, the structural features of the image forming apparatus in this embodiment, which are similar to those in the first embodiment are not going to be described.

(2-1: Flow of Lubrication Toner Delivery Process)

Next, referring to FIG. 3, the flow of the lubrication toner deliver process in this embodiment is described. Incidentally, the flow of the control sequence of the lubrication toner delivery process is controlled by the control portion 50 of the main assembly of the image forming apparatus.

First, as an image formation start signal is inputted when the image forming apparatus is on standby (S1), the control portion 50 begins rotating the photosensitive drums 1*y*-1*k* and development roller 4*y*1-4*k*1, and begins the formation of electrostatic latent images (S2). As soon as an image formation sequence ends, the amounts W of toner detected by the toner amount detecting portions are stored in the memories 5*y*-5*k*, and then, the control portion 50 starts the post-image formation operation (S3).

Next, the control portion 50 determines whether or not it is necessary to supply the area of contact between the peripheral surface of each of the photosensitive drums 1*y*-1*k* and the corresponding cleaning blade 6, based on the "print count" which is one of the indices usable to determine the amount of usage of the image formation apparatus, and which are stored in the memories 5*y*-5*k* (S4). Here, if the print count is equal to a preset value, it is determined that the area of contact needs to be supplied with lubrication toner (Yes in S4). If the print count is no more than the preset value, it is determined that the lubrication toner delivery is unnecessary (No in S4). In this embodiment, the preset value is 300. Although in this embodiment, the print count is used as the index for determining the amount of usage of the image forming apparatus, the image forming apparatus may be structured so that whether or not the lubrication toner delivery is necessary is determined based on the cumulative number of rotations of the photosensitive drum 1, or print ratio. That is, the index may be anything as long as it can be used to estimate the amount of toner in the area of contact between the peripheral surface of the photosensitive drums 1*y*-1*k* and cleaning blades 6*y*1-6*k*1, respectively.

It is determined whether or not the area of contact needs to be supplied with lubrication toner (S4). If it is determined that the area of contact does not need to be supplied with lubrication toner (No in S4), the control portion 50 puts the image forming apparatus back on standby (S1), and waits for the next image formation start signal.

On the other hand, if it is determined that the area of contact needs to be supplied with lubrication toner (Yes in S4), the control portion 50 detects the amount W of toner in each of the development units 40*y*-40*k*, with the use of toner amount detecting portions which are the same in structure as those in the first embodiment, and compares the detected amount W of toner with the threshold value Ew (S5). If the result of comparison indicates that the amount W of toner in the development unit which belongs to the image formation station, the photosensitive drum 1 of which needs to be supplied with lubrication toner, is greater than the threshold value Ew, a lubrication toner image is formed on the photosensitive drum 1 using the toner supplied from this development unit (S6). That is, the "internal lubrication toner delivery operation" is carried out. If the results of comparison indicates that the amount W of toner in the development unit which belongs to the same image formation station as the photosensitive drum which needs to be supplied with lubrication toner is no more than the threshold value Ew, the amount W of toner in each of the other development units is compared with the threshold value Ew (S7). If the results of comparison show that there are development units, the amount W of toner in which is greater than the threshold value Ew, the lubrication toner is supplied from one of these development units. That is, the "external lubrication toner delivery operation" is carried out as it was in the first embodiment (S9 and S10). As soon as the peripheral surface of the photosensitive drum is supplied with lubrication toner through the "internal lubrication toner delivery operation" or "external lubrication toner delivery operation" (S7), the control portion 50 puts the image forming apparatus back on standby (S1), and waits for the next image formation start signal.

Incidentally, the image forming apparatus may be designed so that when multiple development units are greater in the amount W of toner therein than the threshold value Ew, a lubrication toner image is formed using the toners from multiple development units. Further, if it becomes necessary to simultaneously supply two or more photosensitive drums 1 with lubrication toner, the "internal lubrication toner delivery operation" and "external lubrication toner delivery operation" may be simultaneously carried out. If the results of comparison indicates that none of the development units 40*y*-40*k* is no more in the amount W of toner therein than the threshold value Ew, all that is necessary is to carry out the "internal lubrication toner delivery operation" or "external lubrication toner deliver operation" using the development unit which is largest in the amount W of toner therein.

That is, in this embodiment, if the amount W of toner in a given development unit is insufficient to carry out the "internal lubrication toner delivery operation", lubrication toner can be supplied from the other development units which are greater in the amount W of toner therein. Therefore, the above-described problems which image forming apparatuses based on the prior arts suffer do not occur. That is, the image forming apparatus in this embodiment does not suffer from such problems that the shortage of lubrication toner between the peripheral surface of an image bearing member and a cleaning blade reduces an image forming apparatus in image quality, generates abnormal sounds, and makes the toner supply insufficient in the midst of image formation.

To sum up, the present invention makes it possible to provide an electrophotographic image forming apparatus which has multiple image bearing members, and corresponding number of combinations of a development unit and a cleaning unit, and which can provide the peripheral surface of each image bearing member with a satisfactory amount of lubrication toner while no image is formed during an image forming operation.

Embodiment 3

Figure 4:
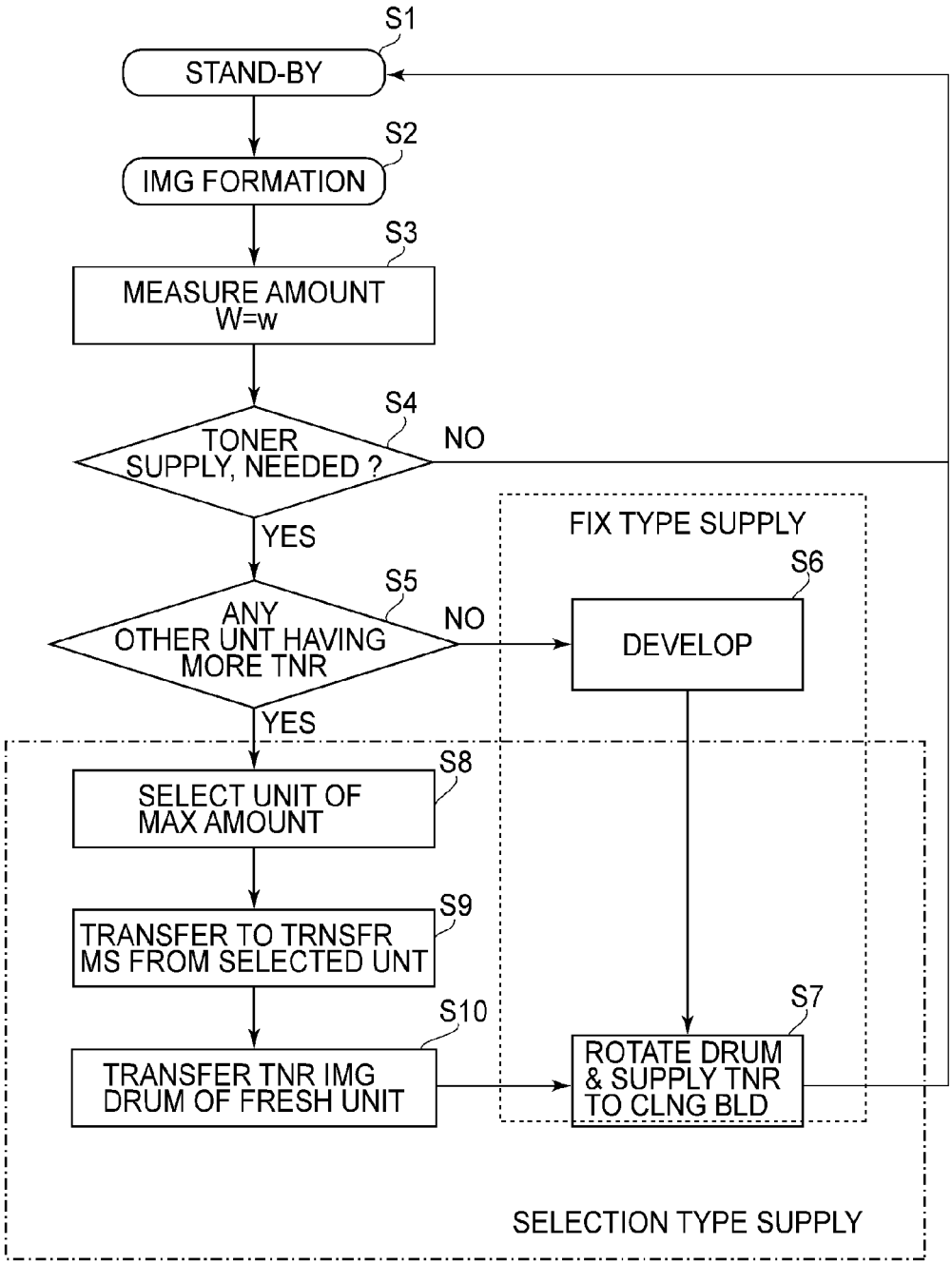
FIG. 4 is a flowchart of the process for supplying the peripheral surface of a specific image bearing member with toner, in the third preferred embodiment of the present invention.

Next, referring to FIG. 4, the third preferred embodiment of the present invention is described. The characteristic feature of the image forming apparatus in this embodiment is that if it is determined that the peripheral surface of one of the photosensitive drums needs to be supplied with lubrication toner, and the development unit which belongs to the same image formation station as the photosensitive drum, the peripheral surface of which needs to be supplied with lubrication toner, is smaller in the amount W of toner therein than the other development units, lubrication toner is supplied from the other development units. Incidentally, this embodiment is not different from the first and second embodiment, except for the flow of the process for delivering lubrication toner. The structural features in this embodiment, which are the same as those in the first and second embodiments are not going to be described.

(3-1: Flow of Lubrication Toner Delivery Process)

First, referring to FIG. 4, the flow of the process for delivering lubrication toner, in this embodiment, is described. Incidentally, the control flow which will be described next is controlled by the control portion 50 with the main assembly of the image forming apparatus is provided.

As an image formation start signal is inputted when the image forming apparatus is on standby (S1), the control portion 50 begins to rotate the photosensitive drums 1*y*-1*k* and development rollers 4*y*1-4*k*1, and begins an image forming operation (S2). As the sequence for forming an image ends, the amounts W of toner in the development units 40*y*-40*k* detected by the toner amount detecting portions are stored in memories 5*y*-5*k*, respectively, and the control portion 50 continues to rotate the photosensitive drums 1*y*-1*k* for a preset length of time, or preset number of times (post rotation) (S3).

Next, the control portion 50 determines whether or not it is necessary to supply the area of contact between the peripheral surface of each of the photosensitive drums 1*y*-1*k* and the corresponding cleaning blade 6, based on the "print count" which is one of the indices usable to determine the amount of usage of the image formation apparatus, and which are stored in the memories 5*y*-5*k* (S4). Here, if the print count is equal to a preset value, it is determined that the area of contact needs to be supplied with lubrication toner (Yes in S4). If the print count is no more than the preset value, it is determined that the lubrication toner delivery is unnecessary (No in S4). In this embodiment, the preset value is 300. Although in this embodiment, the print count is used as the index to determine the amount of usage of the image forming apparatus, the image forming apparatus may be structured so that whether or not the lubrication toner delivery is necessary is determined by using the cumulative number of rotations of the photosensitive drum 1, or print ratio, as the index for determining the amount of usage of the image forming apparatus. That is, the index may be anything as long as it can be used to estimate the amount of toner in the area of contact between the peripheral surface of the photosensitive drums 1*y*-1*k* and cleaning blades 6*y*1-6*k*1, respectively.

It is determined whether or not the area of contact needs to be supplied with lubrication toner (S4). If it is determined that the area of contact does not need to be supplied with lubrication toner (No in S4), the control portion 50 puts the image forming apparatus back on standby (S1), and waits for the next image formation start signal.

On the other hand, if it is determined that the area of contact needs to be supplied with lubrication toner (Yes in S4), the control portion 50 detects the amount W of toner in each of the development units 40 4*yk*, with the use of toner amount detecting portions which are the same in structure as those in the first embodiment, and compares the detected amount W of toner with the amount of toner in each of the other development units to determine whether or not any of the other development units is greater in the amount of toner therein than the developer unit which belongs to the same image formation station as the photosensitive drum which needs to be supplied with lubrication toner (S5). If the result of comparison indicates that the amount W of toner in the development unit which belongs to the image formation station, the photosensitive drum 1 of which needs to be supplied with lubrication toner, is greater in the amount W of toner therein than the other development units, a lubrication toner image is formed on the photosensitive drum using the toner supplied from this development unit (S6). That is, the "internal lubrication toner delivery operation" is carried out. However, if the results of comparison indicates that the amount W of toner in the development unit which belongs to the same image formation station as the photosensitive drum which needs to be supplied with lubrication toner is no more in the amount of toner therein than the other development units, the developer unit which is largest in the amount of toner therein is selected as the lubrication toner source (S8), and the "external lubrication toner delivery operation" is carried out following the same control flow as that in the first embodiment (S10 and S11).

That is, in this embodiment, if the development unit which belongs to the same image formation station as the photosensitive drum which needs to be supplied with lubrication toner is no more in the amount W of toner therein than the other development units, lubrication toner can be supplied from the other development units. Therefore, the image forming apparatus in this embodiment does not suffer from the above-described problems that the shortage in the amount of lubrication toner on the peripheral surface of a photosensitive drum reduces the image forming apparatus in image quality, generates abnormal sounds, and/or makes the image forming apparatus insufficient in the amount of toner in the midst of image formation.

In other words, according to the present invention, it is possible to provide an electrophotographic image forming apparatus which has multiple image bearing members, and the corresponding number of combinations of a development unit and a cleaning apparatus, and which can supply the peripheral surface of each of the multiple image bearing members with a sufficient amount of lubrication toner while no image is formed during an image forming operation.

Miscellaneous Modifications of Embodiment 3

In the preferred embodiments of the present invention described above, the development unit from which lubrication toner is to be delivered is determined based on the amount of toner in the development unit which belongs to the same image formation station as the photosensitive drum which needs to be supplied with lubrication toner. However, the development unit to be used as the lubrication toner source may be selected by comparing the entire development units in terms of usage history, and/or amount of toner therein. That is, an image forming apparatus may be designed so that the development unit which is largest in the amount of toner therein among the entire development units in the main assembly of the image forming apparatus is used as the lubrication toner source. Delivering lubrication toner from a development unit which is lowest in the frequency of usage as described above can reduce the difference among the multiple development units in terms of the amount of toner therein, which is attributable to the difference among the development units in terms of toner consumption therefrom. Therefore, it can reduce the image forming apparatus in cartridge replacement frequency. Further, an image forming apparatus may be designed so that the development unit from which lubrication toner is to be delivered is selected based on the amount of toner in the development units other than the development unit from which lubrication toner is to be delivered. For example, an image forming apparatus may be designed so that when one of its photosensitive drums needs to be supplied with lubrication toner, one of the other development units which are greater in the amount of the toner therein than the threshold value Ew is selected as the lubrication toner source.

Also in the preferred embodiments described above, in a case where the photosensitive drum which needs to be supplied with lubrication toner is going to be supplied with lubrication toner from a development unit which is not the development unit which belongs to the same image formation station as the photosensitive drum which needs to be supplied with lubrication toner, and there are two or more development units which may be selected as the lubrication toner source, lubrication toner is delivered from the development unit which is largest in toner amount. However, this set up is not mandatory. For example, an image forming apparatus may be designed so that among the development units selectable as the lubrication toner source, a development unit which is shortest in the length of time it takes for lubrication toner to be delivered through the conveyance belt. More specifically, in a case where lubrication toner is to be delivered from one of the development units other than the development unit which belongs to the same image formation station as the photosensitive drum which needs to be supplied with lubrication toner, the development unit which is the closest upstream development unit which belongs to the photosensitive drum which needs to be supplied with lubrication toner, in terms of the moving direction of the conveyance belt, is selected as the priority lubrication toner source. This setup can reduces the length of time it takes for lubrication toner to be delivered by way of the conveyance belt.

Embodiment 4

Figure 5:
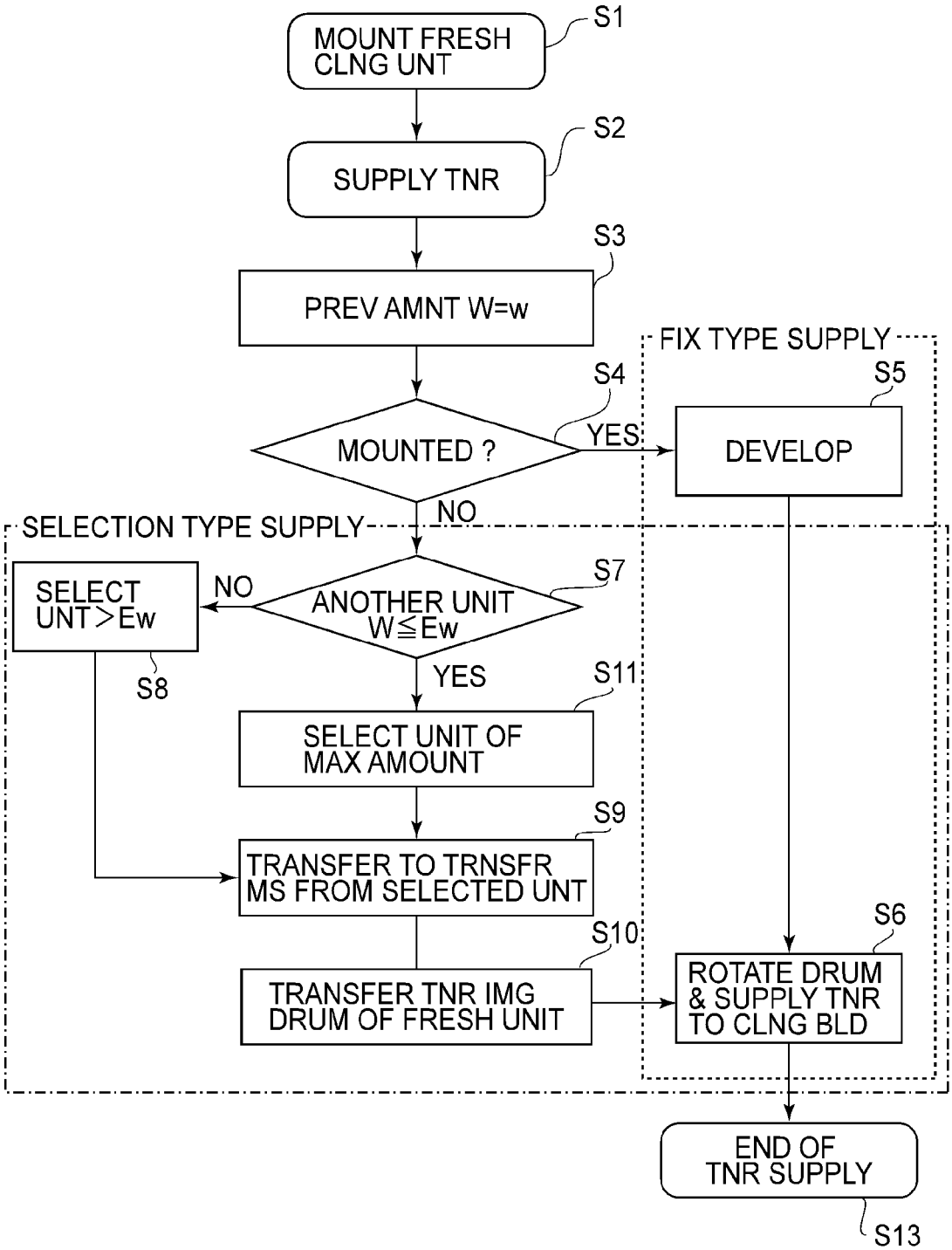
FIG. 5 is a flowchart of the process for supplying the peripheral surface of a specific image bearing member with toner, in the fourth preferred embodiment of the present invention.

Next, referring to FIG. 5, the fourth preferred embodiment of the present invention is described. In this embodiment, the image forming apparatus is structured so that the development units 40*y*-40*k* are removably mountable in the main assembly of the image forming apparatus, and also that even when some of the development units 40*y*-40*k* are not in the main assembly, the lubrication toner delivery process can be satisfactorily carried out. This embodiment is not different from the first, second, and third embodiments described above, except for the flow of the sequence of the lubrication toner delivery process. Thus, the structural features in this embodiment, which are the same as those in the first, second, and third embodiments, are not going to be described.

(4-1: Flow of Lubrication Toner Delivery Sequence)

Referring to FIG. 5, the flow of the lubrication toner delivery sequence in this embodiment is described. Incidentally, in this embodiment, the flow of the lubrication toner delivery sequence, which will be described hereafter, is carried out by the control portion 50 of the main assembly of the image forming apparatus.

First, the control portion 50 determines whether or not any of the cleaning units in the main assembly of the image forming apparatus is brand-new. If it determines that one of the cleaning units is brand-new (S1), it begins delivering lubrication toner to the photosensitive drum 1 in the brand-new cleaning unit (S2). As the lubrication toner delivery is started, it is determined by the development unit detecting portion of the main assembly of the image forming apparatus whether or not each of the development units 40*y*-40*k* is in the main assembly (S3). The development unit detecting portion in this embodiment is such a detecting portion that measures the amount of the torque transmitted to drive each of the development units 40*y*-40*k*. If the amount of the torque transmitted to a given development unit is greater than a preset value, the development unit detecting portion determines that this development unit is in the main assembly. However, an image forming apparatus may be desired so that as any of the development units 40*y*-40*k* is mounted into the main assembly, a switch which corresponds to this development unit is mechanically turned on.

If the results of the development unit detection by the development unit detecting portion indicates that the development unit which belongs to the same image formation station as the photosensitive drum which needs to be supplied with lubrication toner is in the main assembly of the image forming apparatus (Yes in S4), lubrication toner is delivered from this development unit, and a lubrication toner image is formed using the toner from this development unit (S5). That is, the "internal lubrication toner delivery operation" is carried out. On the other hand, if the results of the development unit detection by the development unit detection portion indicates that the development unit which belongs to the same image formation station as the photosensitive drum which needs to be supplied with lubrication toner is not in the main assembly of the image forming apparatus (No in S4), one of the other development units which are in the apparatus main assembly and are greater in the amount W of toner therein than the threshold value Ew is selected as the lubrication toner source (S7). Then, the "external lubrication toner delivery operation" is carried out following the flow similar to that in the first embodiment (S8 and S9). Then, as the peripheral surface of the photosensitive drum which needs to be supplied with lubrication toner is supplied with lubrication toner by the "internal lubrication toner delivery operation" or "external lubrication toner delivery operation" (S6), the lubrication toner delivery process is ended.

The control flow of the lubrication toner delivery process sequence in this embodiment may be combined with the control flow of the lubrication toner delivery process sequence in the first embodiment. For example, if two or more development units in the main assembly of an image forming apparatus are greater in the toner amount W than the threshold value Ew, two or more developments which are greater in toner amount W than the threshold value Ew may be selected as the lubrication toner sources so that a lubrication toner image is formed of the toners from these development units. Further, if it becomes necessary for two or more photosensitive drums to be supplied with lubrication toner at the same time, the "internal lubrication toner delivery operation" and "external lubrication toner delivery operation" may be simultaneously carried out. Incidentally, if the results of comparison reveals that all the development units 40*y*-40*k* in the apparatus main assembly is below the threshold value Ew in the toner amount W, all that is necessary is to carry out the "internal lubrication toner delivery operation" or "external lubrication toner delivery operation" with the use of the development unit which is largest in the toner amount W among all the development units. Further, a step in which whether or not the area of contact between the peripheral surface of each of the photosensitive drums 1*y*-1*k* and the cleaning blades 6*y*1-6*k*1, respectively, requires lubrication toner is determined based on the "print count" which is one of the indices usable to determine the amount of toner usage of the image forming apparatus, as in the first embodiment, may be incorporated.

Further, an image forming apparatus may be designed so that the "internal lubrication toner delivery operation" or "external lubrication toner delivery operation" is carried out always using selecting the development unit which is largest in the amount of toner, as the lubrication toner source.

Further, an image forming apparatus may be designed so that when the development unit which belongs to the same image formation station as the photosensitive drum which needs to be supplied with lubrication toner is less in the toner amount than the other development units, one of the other development units, which is selectable as the lubrication toner source and can make shortest the length of time necessary for lubrication toner delivery, is selected as the lubrication toner source. For example, the development unit which is the closest upstream development unit, in terms of the moving direction of the conveyance belt, of the development unit which belongs to the same image formation station as the photosensitive drum which needs to be supplied with lubrication toner, is selected as the priority lubrication toner source. This design makes it possible to reduce the length of time necessary to deliver lubrication toner to the cleaning blade portion which needs to be supplied with lubrication toner by way of the transfer belt, by carrying out the "external lubrication toner delivery operation.

That is, in this embodiment, if there is not a development unit in the image formation station, the photosensitive member which needs to be supplied with lubrication toner, lubrication toner can be delivered from any of the development units which are in the main assembly of the image forming apparatus and are greater in the toner amount W. Therefore, the above-described old problems do not occur. That is, the image forming apparatus in this embodiment does not suffer from the problems that the shortage in the lubrication toner in the area of contact between the peripheral surface of an image bearing member and the cleaning blade reduces an image forming apparatus in image quality, generates abnormal sounds, and/or makes the image forming apparatus insufficient in the amount of toner in the midst of image formation.

To sum up, according to the present invention, it is possible to provide an electrophotographic image forming apparatus in which multiple image bearing members are provided with their own development unit and cleaning unit, and which can supplies the peripheral surface of each image bearing member with a sufficient amount of lubrication toner while no image is being formed during an image forming operation.

Miscellaneous Modifications of Embodiment 4

In the fourth embodiment, the image forming apparatus was structured so that the development units 40*y*-40*k* and cleaning units 20*y*-20*k* are removably mountable in the main assembly of the apparatus. However, the present invention is applicable also to an image forming apparatus structured so that multiple process cartridges which comprise an integrated combination of a development unit 40 and a cleaning unit 20 are removably mountable in the main assembly of the apparatus. That is, by combining the "internal lubrication toner delivery operation" and "external lubrication toner delivery operation", it is possible to obtain the same effects as those described above.

In the preceding embodiments, the circularly movable member by which lubrication toner was delivered was the conveyance belt 10 which conveys recording sheet P onto which a toner image is transferred. However, the present invention is applicable also to an image forming apparatus structured so that the circularly movable belt 10 is an intermediary transfer belt (intermediary transferring member) onto which toner images are transferred (first transfer) from the peripheral surface of the photosensitive drums 1*y*-1*k*, and from which the toner images are transferred (second transfer) onto a sheet of recording medium. That is, the same effects as those described above can be obtained by transferring a lubrication toner image onto the peripheral surface of a photosensitive drum which needs to be supplied with lubrication toner, from a development unit which is not the development unit which belongs to the same image formation station as the photosensitive drum which needs to be supplied with lubrication toner, by way of the intermediary transfer belt, when carrying out the "external lubrication toner delivery operation". Further, the intermediary transfer member may be in the form of a drum instead of an endless belt.

Also in the preceding embodiments, the image forming apparatuses were structured so that the development units 40*y*-40*k* and cleaning units 20*y*-20*k* were removably mountable in the main assembly of the apparatus. However, the present invention is also applicable to an image forming apparatus structured so that the development units 40*y*-40*k* and cleaning units 20*y*-20*k* are not removably mountable. Further, the present invention is applicable also to an image forming apparatus, the photosensitive drum 1*y*-1*k* of the cleaning units 20*y*-20*k*, and the cleaning apparatuses 6*y*-6*k* of the cleaning units 20*y*-20*k* of which are independent from each other, respectively. Further, the present invention is also applicable to an image forming apparatus, the four cleaning units 20*y*-20*k* which are integrated. That is, even if the present invention is applied to an image forming apparatus which is slightly differently structured, as described above, from the image forming apparatuses in the preceding embodiments, the same effects as those described above can be obtained.

Also in the preceding embodiments, the image forming apparatuses were structured so that the development rollers 40*y*1-40*k*1 are placed in contact with the peripheral surface of the photosensitive drums 1*y*-1*k*, respectively, to develop the latent images on the peripheral surface of the photosensitive drums 1*y*-1*k*, respectively. However, the present invention is also applicable to an image forming apparatus which uses the so-called jumping developing method, which is a nonmagnetic and noncontact developing method. That is, even if the present invention is applied to an image forming apparatus structured to uses a noncontact developing method, the same effects as those described above can be obtained.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications No. 289391/2009 and 275757/2010 filed Dec. 21, 2009 and Dec. 10, 2010 which is hereby incorporated by reference.

What is claimed is:

1. An image forming apparatus comprising:

a first image bearing member for bearing an electrostatic latent image;

a first developing device for developing the electrostatic latent image with toner into a toner image on said first image bearing member;

a first cleaning device having a cleaning blade for removing residual toner from said first image bearing member;

a second image bearing member for bearing an electrostatic latent image;

a second developing device for developing the electrostatic latent image with toner into a toner image on the second image bearing member;

a second cleaning device having a cleaning blade for removing residual toner from said second image bearing member;

a rotatable member contactable to said first image bearing member and said second image bearing member, wherein said rotatable member is an intermediary transfer member for receiving the toner images formed on said first image bearing member and said second image bearing member and for transferring the toner images received by said rotatable member onto a sheet material, or a feeding member for feeding a sheet material for receiving the toner images formed on said first image bearing member and said second image bearing member; and a control device for controlling a toner supply process for supplying toner to an area of contact between said first image bearing member and said cleaning blade of said first cleaning device when formation of the toner images to be transferred onto the sheet material is not carried out, wherein said control device selects one of a toner supply process using the toner accommodated in said first developing device and a toner supply process using the toner accommodated in said second developing device, in accordance with an amount of the toner accommodated in each of said first developing device and said second developing device.

2. An apparatus according to claim 1, wherein in the toner supply process using the toner accommodated in said second developing device, the toner is supplied from said second developing device to said second image bearing member, and the toner supplied to said second image bearing member is supplied to said first image bearing member by way of said rotatable member.

3. An apparatus according to claim 1, wherein (i) when the amount of the toner accommodated in said first developing device is larger than a predetermined level, the toner supply process is executed using the toner accommodated in said first developing device, and (ii) when the amount of the toner accommodated in said first developing device is not larger than the predetermined level, the toner supply process is executed using the toner accommodated in said second developing device.

4. An apparatus according to claim 1, wherein (i) when the amount of the toner accommodated in said first developing device is larger than the amount of the toner accommodated in said second developing device, the toner supply process is executed using the toner accommodated in said first developing device, and (ii) when the amount of the toner accommodated in said first developing device is smaller than the amount of the toner accommodated in said second developing device, the toner supply process is executed using the toner accommodated in said second developing device.

5. An apparatus according to claim 1, wherein (i) when the amount of the toner accommodated in said second developing device is larger than the predetermined level, the toner supply process is executed using the toner accommodated in said second developing device, and (ii) when the amount of the toner accommodated in said second developing device is smaller than the predetermined level, the toner supply process is executed using the toner accommodated in said first developing device.

6. An apparatus according to claim 1, further comprising a plurality of second developing devices, wherein when the toner supply process is executed using the toner accommodated in said second developing device, one developing device selected from said plurality of developing devices for which time required to supply the toner from said one of said plurality of second developing devices to said first image bearing member is shortest is used as said second developing device.

7. An apparatus according to claim 1, wherein (i) when the amount of the toner accommodated in said first developing device is larger than a predetermined level, the toner supply process is executed using the toner accommodated in said first developing device, and (ii) when the amount of the toner accommodated in said first developing device is smaller than the predetermined level, and the amount of the toner accommodated in said second developing device is larger than the predetermined level, the toner supply process is executed using the toner accommodated in said second developing device, and (iii) when the amount of the toner accommodated in said first developing device is smaller than the predetermined level, and the amount of the toner accommodated in said second developing device is smaller than the predetermined level, the toner supply process is executed using the toner accommodated in said developing device selected from said first developing device and said second developing device of which the amount of the accommodated toner is larger.

8. An apparatus according to claim 1, wherein at least one of said first developing device and a cleaning unit containing said first cleaning device and said first image bearing member and contained in a process cartridge which is detachably mountable to a main assembly of the apparatus.

9. An apparatus according to claim 1, wherein said first image bearing member, said first developing device and said first cleaning device are contained in a process cartridge as a unit which is detachably mountable to a main assembly of the apparatus.

10. An apparatus according to claim 1, wherein the toner supply process is executed when an amount of usage of the apparatus reaches a predetermined level.

11. An image forming apparatus comprising:

a first image bearing member for bearing an electrostatic latent image;

a first developing device for developing the electrostatic latent image with toner into a toner image on said first image bearing member;

a first cleaning device having a cleaning blade for removing residual toner from said first image bearing member;

a second image bearing member for bearing the electrostatic latent image;

a second developing device for developing the electrostatic latent image with toner into a toner image on the second image bearing member;

a second cleaning device having a cleaning blade for removing residual toner from said second image bearing member;

a rotatable member contactable to said first image bearing member and said second image bearing member, wherein said rotatable member is an intermediary transfer member for receiving the toner images formed on said first image bearing member and said second image bearing member and for transferring the toner images received by said rotatable member onto a sheet material, or a feeding member for feeding a sheet material for receiving the toner images formed on said first image bearing member and said second image bearing member; and a control device for controlling a toner supply process for supplying toner to an area of contact between said first image bearing member and said cleaning blade of said first cleaning device when formation of the toner images to be transferred onto the sheet material is not carried out, wherein said first developing device is detachably mountable to a main assembly of the apparatus, and when said first developing device is mounted to the main assembly of the apparatus, said control device executes the toner supply process using the toner accommodated in said first developing device, and when said first developing device is not mounted to the main assembly of the apparatus, said control device executes the toner supply process using the toner accommodated in said second developing device.

12. An apparatus according to claim 11, wherein in the toner supply process using the toner accommodated in said second developing device, the toner is supplied from said second developing device to said second image bearing member, and the toner supplied to said second image bearing member is supplied to said first image bearing member by way of said rotatable member.

13. An apparatus according to claim 11, further comprising a plurality of second developing devices, wherein when the toner supply process is executed using the toner accommodated in said second developing device, one developing device selected from said plurality of second developing devices for which time required to supply the toner from said one of said plurality of second developing devices to said first image bearing member is shortest is used as said second developing device.

14. An apparatus according to claim 11, further comprising a plurality of second developing devices, wherein when the toner supply process is executed using the toner accommodated in said second developing device, the toner supply process is executed using one of said plurality of second developing devices that accommodates a largest amount of the toner.

15. An apparatus according to claim 11, further comprising a plurality of second developing devices, wherein (i) when the toner supply process is executed using the toner accommodated in said second developing device, and the amount of the toner accommodated in said second developing device is larger than a predetermined level, the toner supply process is executed using the toner contained in any one of said plurality of second developing devices, and (ii) when the amount of the toner accommodated in said second developing device is smaller than the predetermined level, the toner supply process is executed using the toner contained in one of said plurality of second developing devices that accommodates a largest amount of the toner.

16. An apparatus according to claim 11, wherein the toner supply process is executed when said cleaning device is detachably mountable to a main assembly of the apparatus.

17. An apparatus according to claim 11, wherein the toner supply process is executed when an amount of usage of the apparatus reaches a predetermined level.

* * * * *